US007628047B2

(12) United States Patent
Lee

(10) Patent No.: US 7,628,047 B2
(45) Date of Patent: Dec. 8, 2009

(54) COMPOUND LOCK

(75) Inventor: Miko Lee, Taipei Hsien (TW)

(73) Assignee: ABA UFO International Corp., Hsin Chuang, Taipei Hsien (TW)

( * ) Notice: Subject to any disclaimer, the term of this patent is extended or adjusted under 35 U.S.C. 154(b) by 89 days.

(21) Appl. No.: 11/924,502

(22) Filed: Oct. 25, 2007

(65) Prior Publication Data

US 2009/0107193 A1 Apr. 30, 2009

(51) Int. Cl.
*E05B 37/00* (2006.01)

(52) U.S. Cl. ..... 70/284; 70/213; 70/312; 70/134; 70/379 R

(58) Field of Classification Search ..... 70/284, 70/285, 379 R–381, 104, 224, 124, 128, 129, 70/133, 134, 213, 215, 312
See application file for complete search history.

(56) References Cited

U.S. PATENT DOCUMENTS

| | | | | |
|---|---|---|---|---|
| 2,035,781 | A * | 3/1936 | Bell | 70/285 |
| 2,424,396 | A * | 7/1947 | Heyer | 70/285 |
| 3,383,886 | A * | 5/1968 | Hermann | 70/284 |
| 3,395,557 | A * | 8/1968 | Berkowitz | 70/285 |
| 3,572,069 | A * | 3/1971 | Junkunc | 70/285 |
| 4,726,204 | A * | 2/1988 | Peyronnet | 70/315 |
| 6,508,089 | B1 * | 1/2003 | Tsai | 70/213 |
| 6,513,356 | B1 * | 2/2003 | Yang | 70/213 |
| 6,708,538 | B1 * | 3/2004 | Walby | 70/285 |
| 7,266,981 | B2 * | 9/2007 | Flory et al. | 70/284 |
| 7,367,207 | B2 * | 5/2008 | Yang | 70/284 |
| 7,444,844 | B1 * | 11/2008 | Lee | 70/21 |
| 7,458,239 | B1 * | 12/2008 | Ma | 70/21 |
| 2002/0088256 | A1 * | 7/2002 | Taylor et al. | 70/25 |
| 2005/0166649 | A1 * | 8/2005 | Meekma | 70/134 |
| 2006/0248932 | A1 * | 11/2006 | Yang | 70/284 |

* cited by examiner

*Primary Examiner*—Suzanne D Barrett
(74) *Attorney, Agent, or Firm*—Kolisch Hartwell, PC

(57) ABSTRACT

A compound lock has a common housing, a latch assembly, a supplementary lock and a combination lock. The latch assembly is rotatably attached to and protrudes from the common housing. The combination lock and supplementary lock are mounted in the common housing and engage the latch assembly, and either may rotate the latch assembly. Thus, in general, people may unlock the compound lock using either the combination lock or the supplementary lock with a key when the combination is forgotten without breaking the compound lock.

19 Claims, 11 Drawing Sheets

COMPOUND LOCK

BACKGROUND OF THE INVENTION

1. Field of the Invention

The present invention relates to a lock, and more particularly to a compound lock that integrates two different lock assemblies in a housing and can be unlocked with a key or by dialing a combination.

2. Description of the Prior Arts

The combination lock is a simple lock, is commonly used, is locked or unlocked by turning wheels and obviates the risk of losing a key. People use combinations in many things like ATMs (automated teller machines), safes, personal computers, encryption of files or access to a specific network. However, a single combination for all applications is a significant security risk, in that someone identifying one combination will be able to access all other applications that use the same combination.

People usually set different combinations in different things for safety, but remembering the correct combination is more difficult. When a person forgets a digital combination that was set in a device like an ATM or a computer, he can inquire or reset a combination. However, when the combination of a mechanical combination lock is forgotten, the only way to remove the lock usually requires breaking the lock. Therefore, people must remember every single combination of all mechanical combination locks to successfully unlock them. It is really inconvenient.

To overcome the shortcomings, the present invention provides a compound lock to mitigate or obviate the aforementioned problems.

SUMMARY OF THE INVENTION

The main objective of the present invention is to provide a compound lock that can be unlocked with a key even though the combination to the lock is forgotten to prevent having to break the lock.

The compound lock in accordance with the present invention comprises a common housing, a latch assembly, a supplementary lock and a combination lock. The common housing has a cap that is selectively rotatable. The latch assembly is rotatably attached to and protrudes from the common housing. The supplementary lock is mounted in the common housing and engages and selectively rotates the latch assembly. The combination lock connects the cap to the latch assembly so the latch assembly can be rotated. Thus, people may unlock the compound lock using either the combination lock or the supplementary lock with a key when the combination is forgotten without breaking the compound lock.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
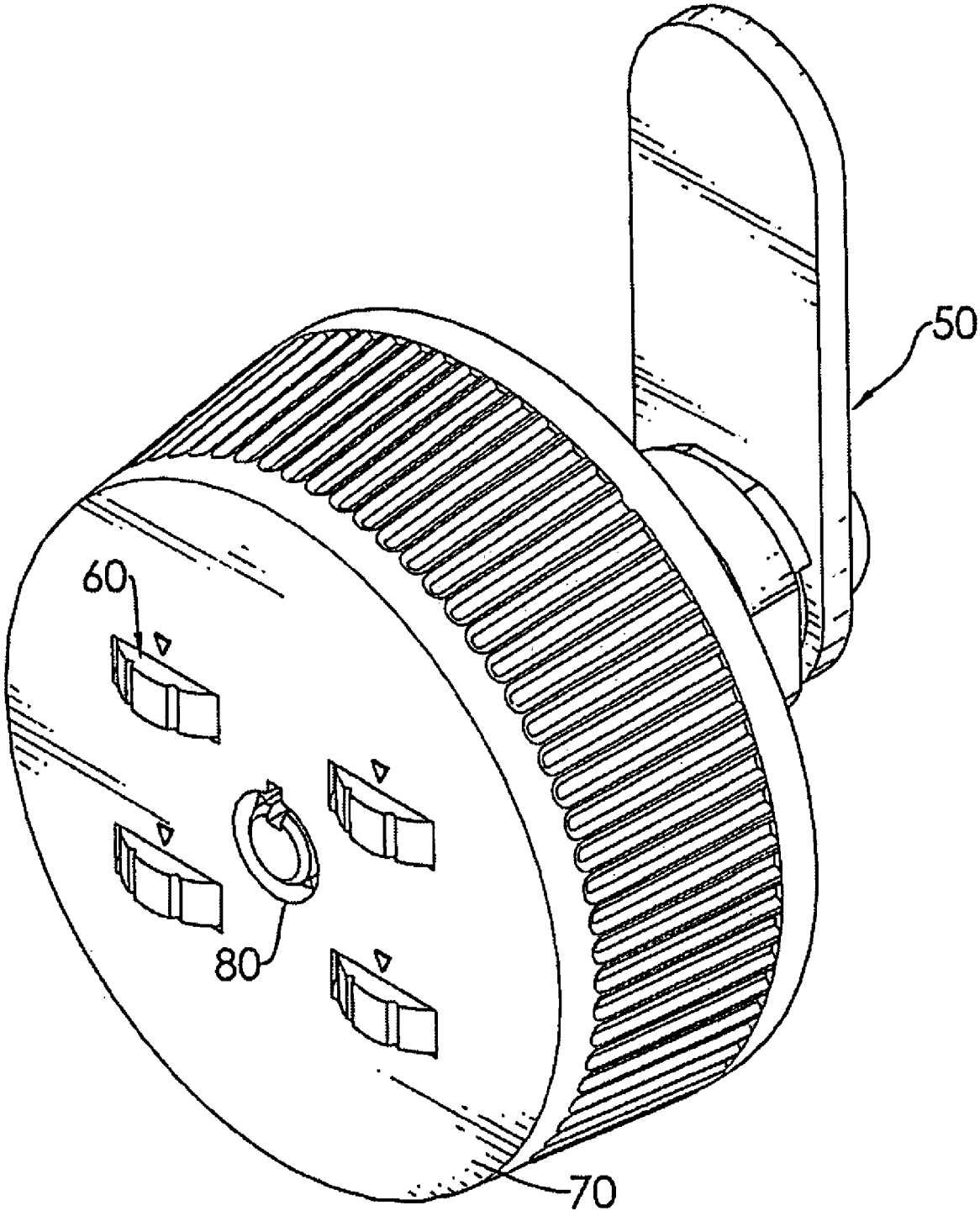
FIG. 1 is a perspective view of a first embodiment of a compound lock in accordance with present invention.
Figure 2:
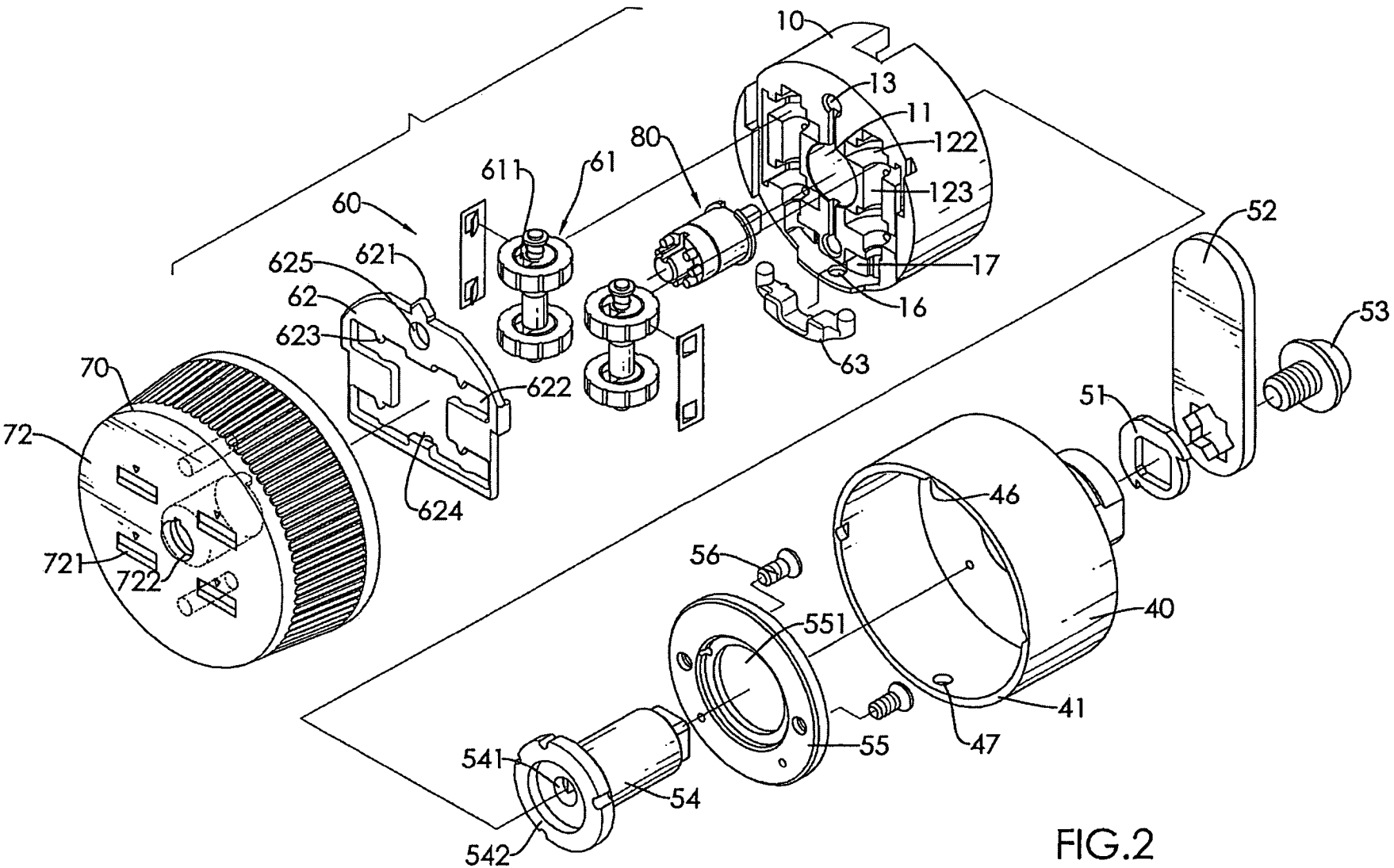
FIG. 2 is an exploded perspective view of the lock in FIG. 1.

With reference to FIGS. 1, 2 and 7 to 9, a compound lock in accordance with the present invention is mounted on an article and comprises a common housing, a latch assembly (50), a supplementary lock (80, 80') and a combination lock (60). The article may be a drawer, a cabinet or the like and has a front panel (AA), a mounting hole (BB) and a mounting nut (CC).

The common housing comprises an outer housing (40), an inner housing (10, 10') and a cap (70).

Figure 3:
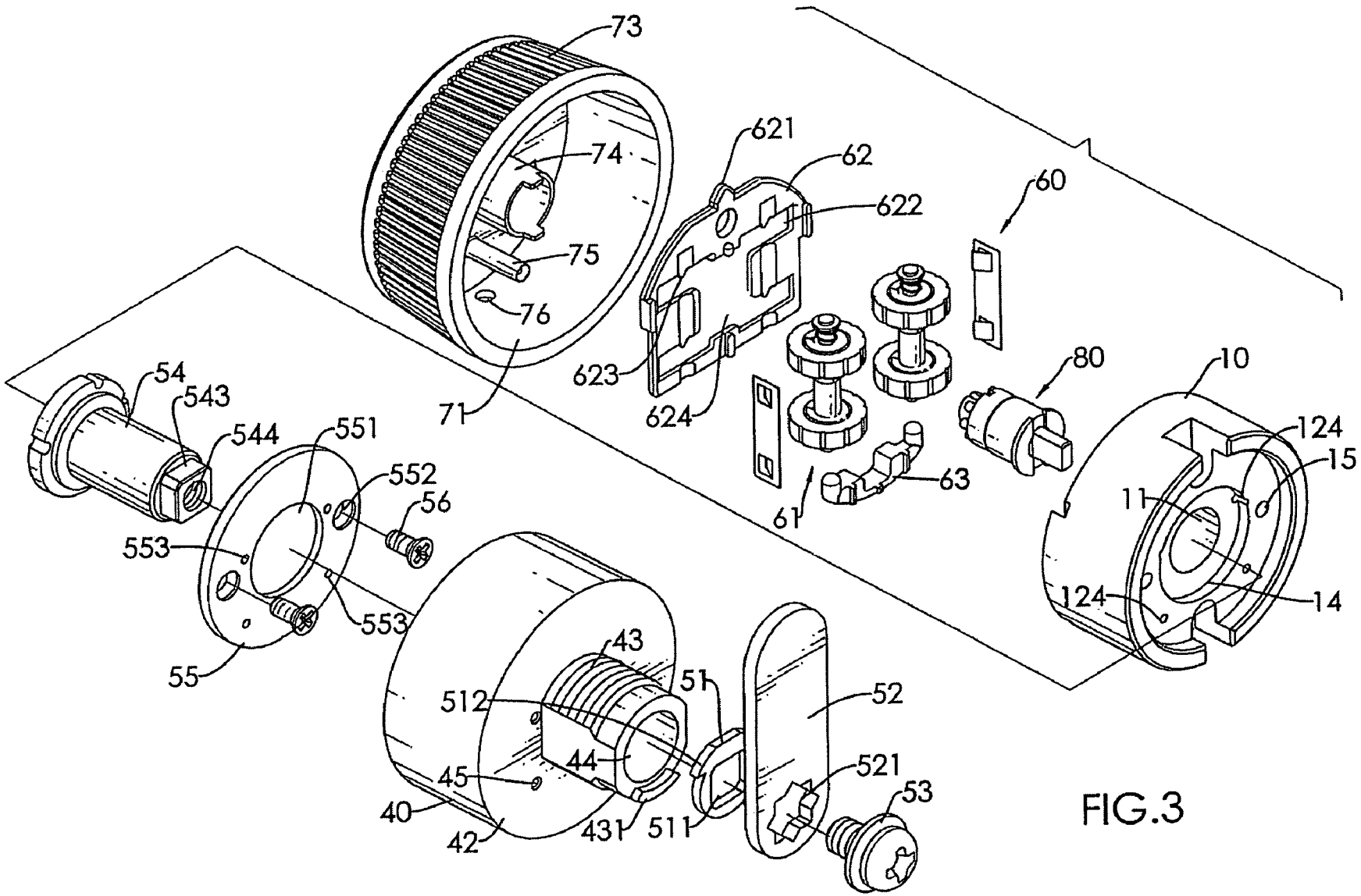
FIG. 3 is another exploded perspective view of the lock in FIG. 1.

With further reference to FIG. 3, the outer housing (40) has a front, a rear, an inner surface, a sidewall, a front edge (41), a cover (42), an extension tube (43), a central hole (44) and at least one notch (46) and may have multiple identification holes (45) and a through hole (47).

The front edge (41) is formed on the front of the outer housing (40).

The cover (42) is formed on the rear of the outer housing (40).

The extension tube (43) is formed coaxially on and protrudes longitudinally from the cover (42), is mounted in the mounting hole (BB) of the article and has an outer surface, an end surface, a thread and an optional positive stop (431). The thread is formed on the outer surface. The mounting nut (CC) screws onto the thread of the extension tube (43) to hold the extension tube (43) securely in the mounting hole (BB) of the front panel (AA) of the article.

The positive stop (431) is an arc and is formed concentrically on and protrudes longitudinally from the end surface.

The central hole (44) is formed through the extension tube (43) and the cover (42) and may be a threaded hole.

The at least one notch (46) is formed in the inner surface of the outer housing (40) at the front edge (41).

The identification holes (45) are formed through the cover (42) around the extension tube (43).

The through hole (47) is formed through the sidewall of the outer housing (40) near the front edge (41).

Figure 4:
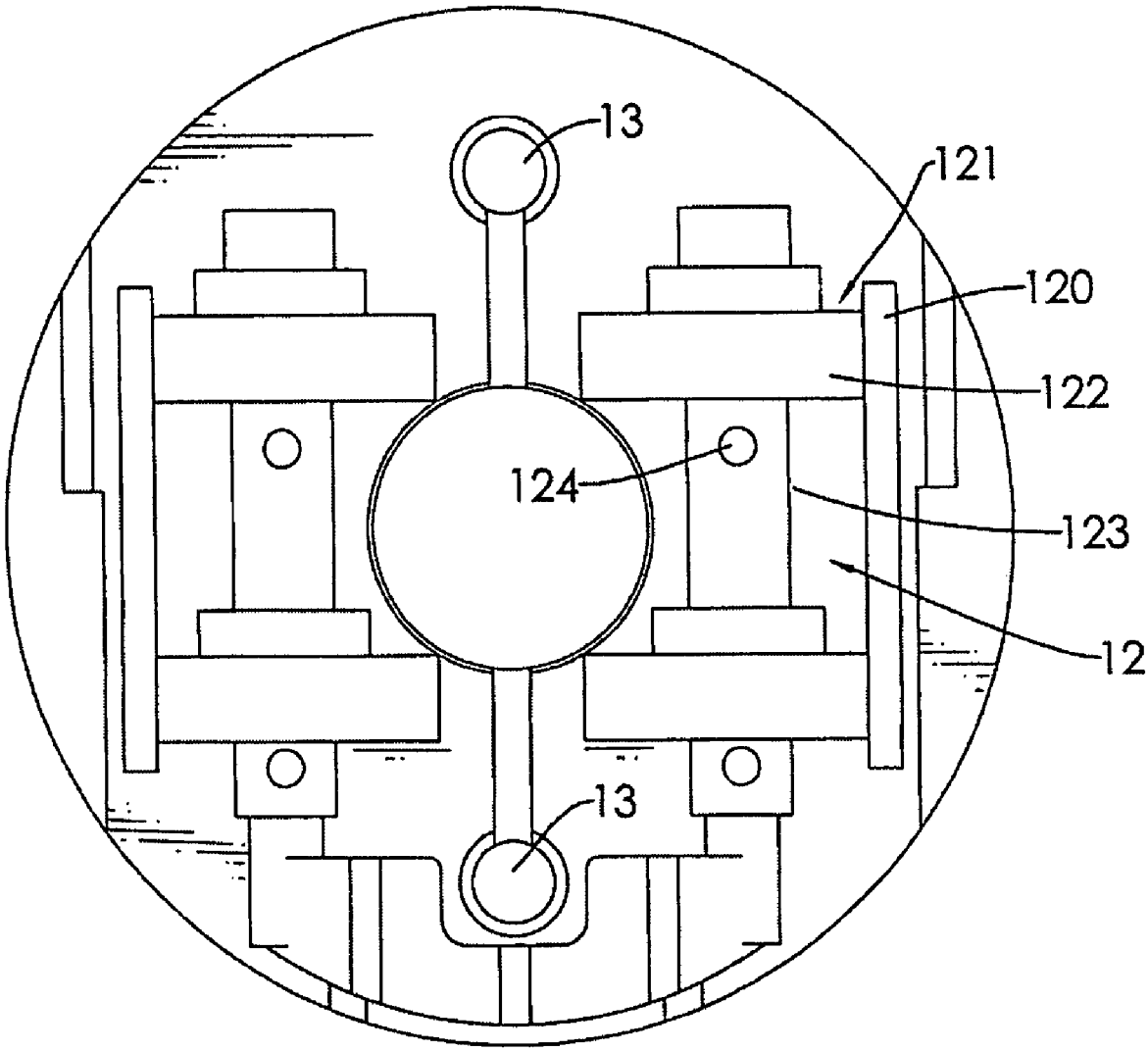
FIG. 4 is a front view of an inner housing of the lock in FIG. 1.

With further reference to FIG. 4, the inner housing (10, 10') is cylindrical, is mounted coaxially in the outer housing (40), has a front surface, a rear surface, a supplementary lock hole (11, 11') and at least one combination assembly recess (12) and may have multiple positioning holes (13), multiple fastening holes (15), an edge, a recess (14), a through hole (16) and a combination yoke recess (17).

The supplementary lock hole (11, 11') is formed coaxially through, the inner housing (10, 10') and may be implemented as a mounting hole (11) or a mounting tube (11'). The mounting tube (11') has a wall and two notches (111'). The wall protrudes from the front surface of the inner housing (10')

around the mounting tube (11'). The notches (11') are formed on the wall opposite to each other.

The at least one combination assembly recess (12) is formed on the front surface of the inner housing (10, 10'), and each combination assembly recess (12) may be implemented two wheel chambers (121) and a panel recess (120). The wheel chambers (121) are formed opposite to each other on the front surface of the inner housing (10, 10') and connect to each other, and each wheel chamber (121) has a transverse recess (122) and a longitudinal recess (123). The transverse recess (122) of the wheel chamber (121) is parallel to the other transverse recess (122) of the wheel chamber (121). The longitudinal recess (123) connects to the other longitudinal recess (123) of the wheel chamber (121), is perpendicular to the transverse recess (122) and has an optional identification hole (124). The identification hole (124) is formed through the inner housing (10, 10') and aligns with an identification hole (45) in the outer housing (40). The panel recess (120) is formed on the front surface of the inner housing (10, 10') beside the transverse recesses (122).

The positioning holes (13) are formed on the front surface of the inner housing (10, 10').

The fastening holes (15) are formed in the rear surface of the inner housing (10, 10') around the supplementary lock hole (11, 11') and may be a threaded hole.

The edge protrudes from the front surface of the inner housing (10).

The recess (14) is formed in the rear surface of the inner housing (10, 10') coaxially with the supplementary lock hole (11, 11').

The through hole (16) is formed through the edge of the inner housing (10, 10') near the at least one combination assembly recess (12) and corresponds to and aligns with the through hole (47) of the outer housing (40).

The combination yoke recess (17) is formed in the front surface near the edge of the inner housing (10, 10') and connects to the at least one combination assembly recess (12).

The cap (70) is mounted around the outer housing (40), is fastened to the inner housing (10, 10'), has an open rear end (71), a closed front end (72) and a sidewall (73) and may have a fastening bracket (74), multiple rotation posts (75) and a through hole (76).

The closed front end (72) has an inner surface, at least one wheel hole (721) and a supplementary lock hole (722). The wheel holes (721) are formed through the closed front end (72) and correspond respectively to the transverse recesses (122) of the inner housing (10, 10'). The supplementary lock hole (722) corresponds to the supplementary lock hole (11, 11') of the inner housing (10, 10').

The sidewall (73) may be fluted to allow the cap (70) to be firmly gripped.

The fastening bracket (74) is formed coaxially on and protrudes longitudinally from the inner surface of the closed front end (72), is mounted through the mounting hole (11) of the inner housing (10) and has a distal end. The distal end is attached securely to the recess (14) of the inner housing (10).

The rotation posts (75) are formed on and protrude longitudinally from the inner surface of the closed front end (72), are mounted securely in the positioning holes (13) of the inner housing (10, 10') and rotate the inner housing (10, 10').

The through hole (76) is formed through the sidewall (73) of the cap (70) and corresponds to and aligns with the through holes (47, 16) of the outer housing (40) and the inner housing (10, 10').

The latch assembly (50) is connected to the common housing, has a core bracket (54), a mounting collar (55), multiple optional collar fasteners (56), a latch (52) and an optional latch fastener (53) and may have a limit (51).

The core bracket (54) is cylindrical, is connected to the rear surface of the inner housing (10, 10'), has a front end, a rear end and a slot (541) and may have a mounting hole (544), a flange (542) and a keyed protrusion (543).

The slot (541) is formed axially on the front end of the core bracket (54) and communicates with the supplementary lock hole (11, 11') of the inner housing (10, 10').

The flange (542) is formed around and protrudes out from the front end of the core bracket (54) and is mounted in the recess (14) of the inner housing (10, 10').

The keyed protrusion (543) protrudes axially from the rear end of the core bracket (54).

The mounting hole (544) is formed axially in the rear end of the core bracket (54) through the keyed protrusion (543) and may be a threaded hole.

The mounting collar (55) is mounted rotatably around the core bracket (54), fastens to the rear surface of the inner housing (10, 10') to hold the flange (542) of the core bracket (54) between the mounting collar (55) and the rear surface of the inner housing (10, 10'), has a mounting hole (551) and multiple optional through holes (552) and may have multiple identification holes (553).

The mounting hole (551) is formed through the mounting collar (55) and is mounted around the core bracket (54).

The through holes (552) are formed through the mounting collar (55).

The identification holes (553) are formed through the mounting collar (55) and align with the identification holes (45, 124) of the outer housing (40) and the inner housing (10, 10').

The collar fasteners (56) are mounted respectively through the through holes (552) and fasten to the fastening holes (15) of the inner housing (10, 10') to prevent the core bracket (54), the inner housing (10, 10') and the mounting collar (55) from separating, and to allow the core bracket (54) to rotate relative to the inner housing (10, 10') and the mounting collar (55).

The limit (51) is mounted around the keyed protrusion (543), abuts the rear end of the core bracket (54), slidably abuts the end surface of the extension tube (43) and has an edge, a keyed hole (511) and a protrusion (512). The keyed hole (511) corresponds to the keyed protrusion (543) of the core bracket (54) and keeps the limit (51) from rotating relative to the core bracket (54). The protrusion (512) is formed on and protrudes out from the edge of the limit (51) and selectively abuts the positive stop (431) of the outer housing (40) to keep the latch assembly (50) from rotating excessively.

The latch (52) is connected to the rear end of the core bracket (54), is securely mounted around the keyed protrusion (543) of the core-bracket (54) and has a proximal end and an optional keyed hole (521). The proximal end is connected to the rear end of the core bracket (54). The keyed hole (521) is formed through the latch (52) near the proximal end, corresponds to and is mounted securely around the keyed protrusion (543) of the core bracket (54) and keeps the latch (52) from rotating relative to the core bracket (54).

The latch fastener (53) is mounted through the keyed holes (521, 511) of the latch (52) and the limit (51) and screws into the mounting hole (544) of the keyed protrusion (543) of the core bracket (54) to hold the limit (51) and the latch (52) securely on the core bracket (54).

Figure 10:
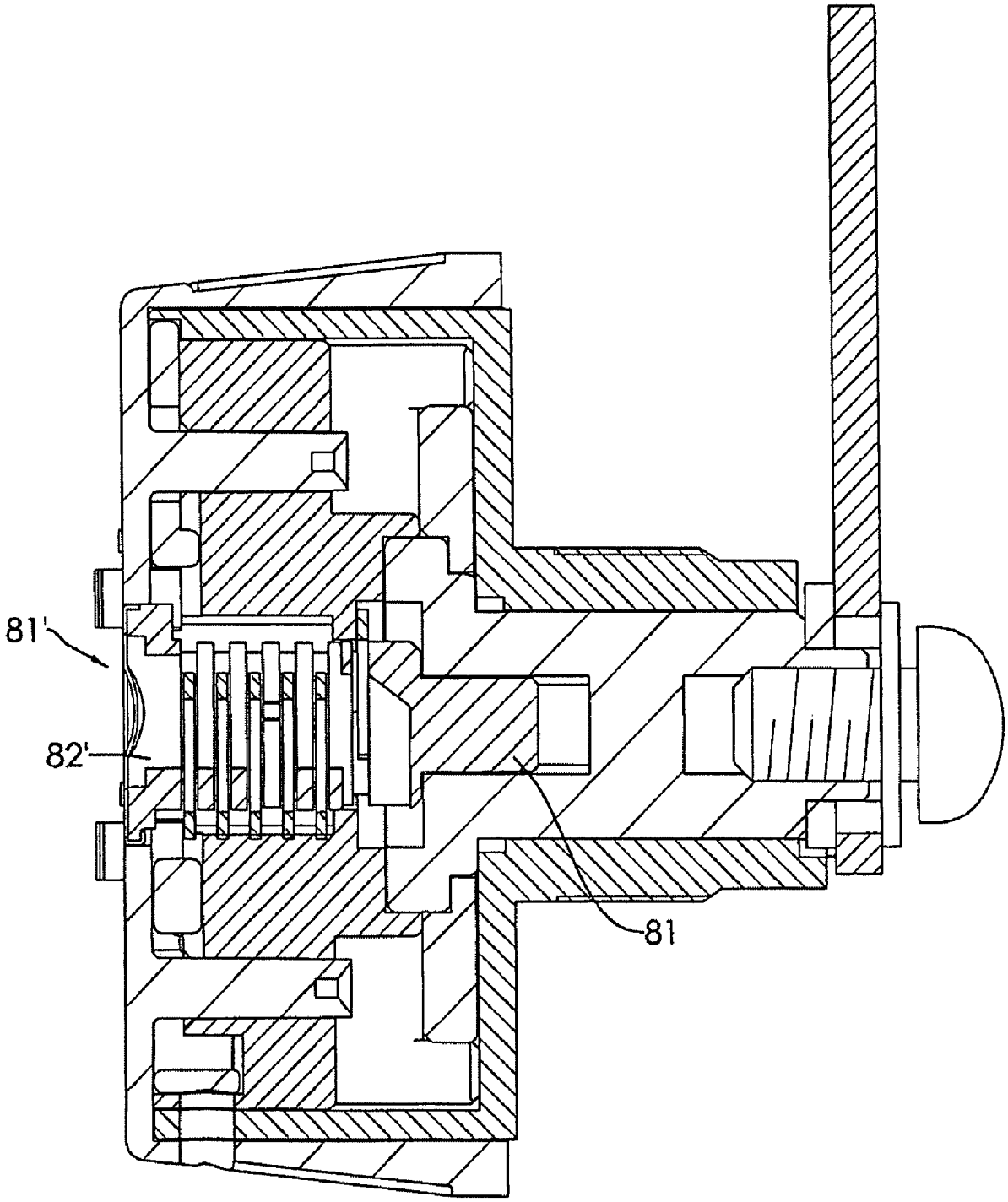
FIG. 10 is a cross-sectional side view of the lock in FIG. 8.
Figure 11:
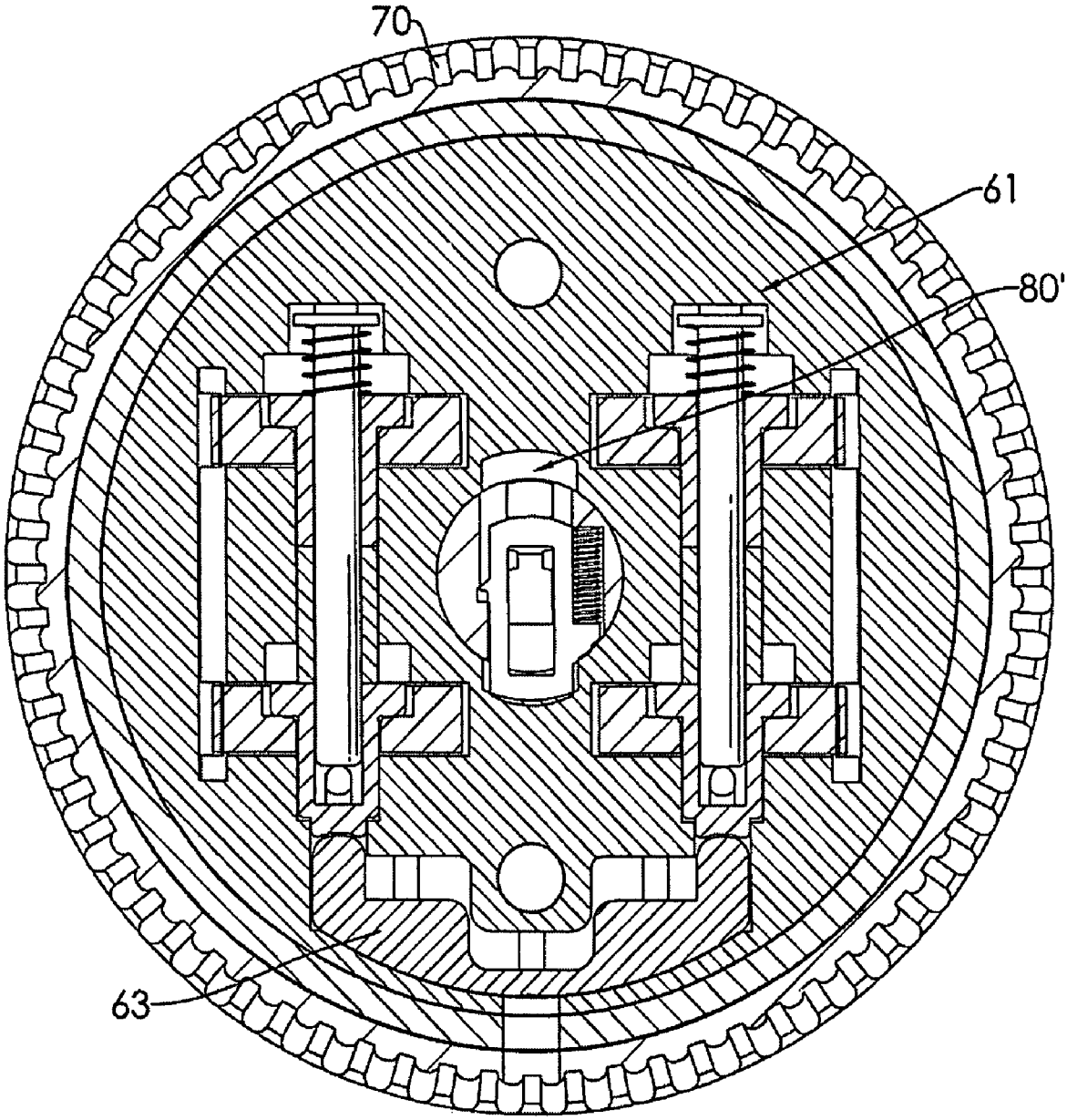
FIG. 11 is a cross-sectional front view of the lock in FIG. 8.

With further reference to FIGS. 10 and 11, the supplementary lock (80, 80') is mounted in the supplementary lock hole (11, 11) of the inner housing (10, 10'), connects to the core bracket (54) to rotate the core bracket (54) to lock or unlock the compound lock, may be implemented with a pin lock assembly (80) or a disc lock assembly (80') and has a rear surface, a front surface, a drive shaft (81) and an optional key mount (82, 82').

The pin lock assembly (80) is mounted securely in the mounting hole (11) of the inner housing (10) and is operated with a cylindrical key.

The disc lock assembly (80') is mounted securely in the mounting tube (11') of the inner housing (10') and is operated with a flat key.

The drive shaft (81) is formed on and protrudes coaxially from the rear surface of the supplementary lock (80, 80') and engages the slot (541) of the core bracket (54).

The key mount (82, 82') is formed coaxially on the front surface of the supplementary lock (80, 80') and is exposed through the supplementary lock hole (722) in the closed front end (72) of the cap (70). The key mount (82) is mounted in the fastening bracket (74) of the cap (70).

The combination lock (60) is mounted in the inner housing (10, 10'), selectively connects to the outer housing (40) or disconnects from the outer housing (40) and has at least one combination assembly (61) and may be implemented with a latch panel (62) and a combination yoke (63).

The at least one combination assembly (61) is rotatably mounted respectively in the at least one combination assembly recess (12) of the front surface of the inner housing (10, 10'), protrudes respectively through the wheel holes (721) in the closed front end (72) of the cap (70) and has at least one unique combination number and at least one combination notch (611). The combination notch (611) corresponds to the unique combination number.

Figure 5:
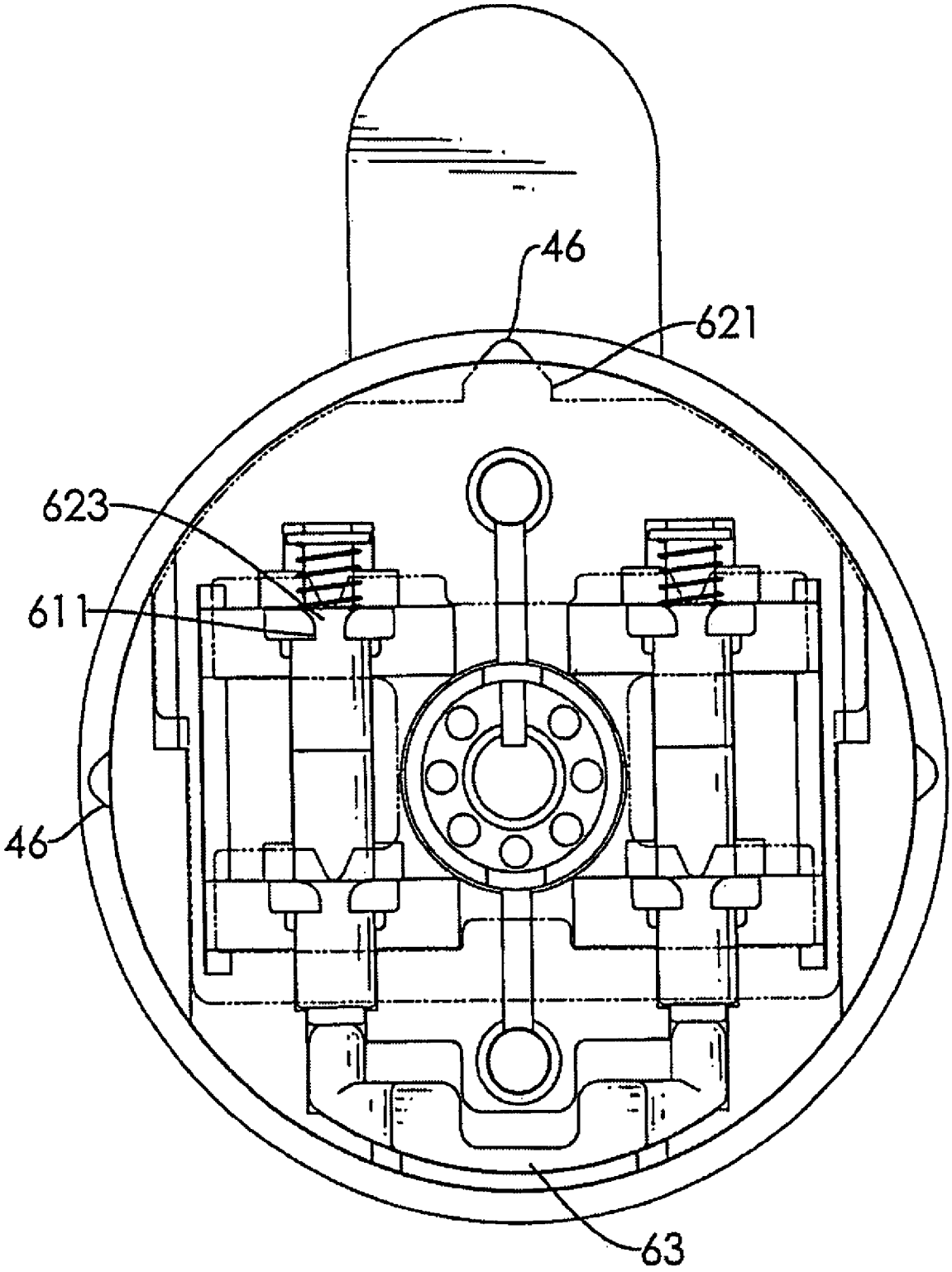
FIG. 5 is a front view of the lock in FIG. 1 without the cap mounted around the lock.
Figure 6:
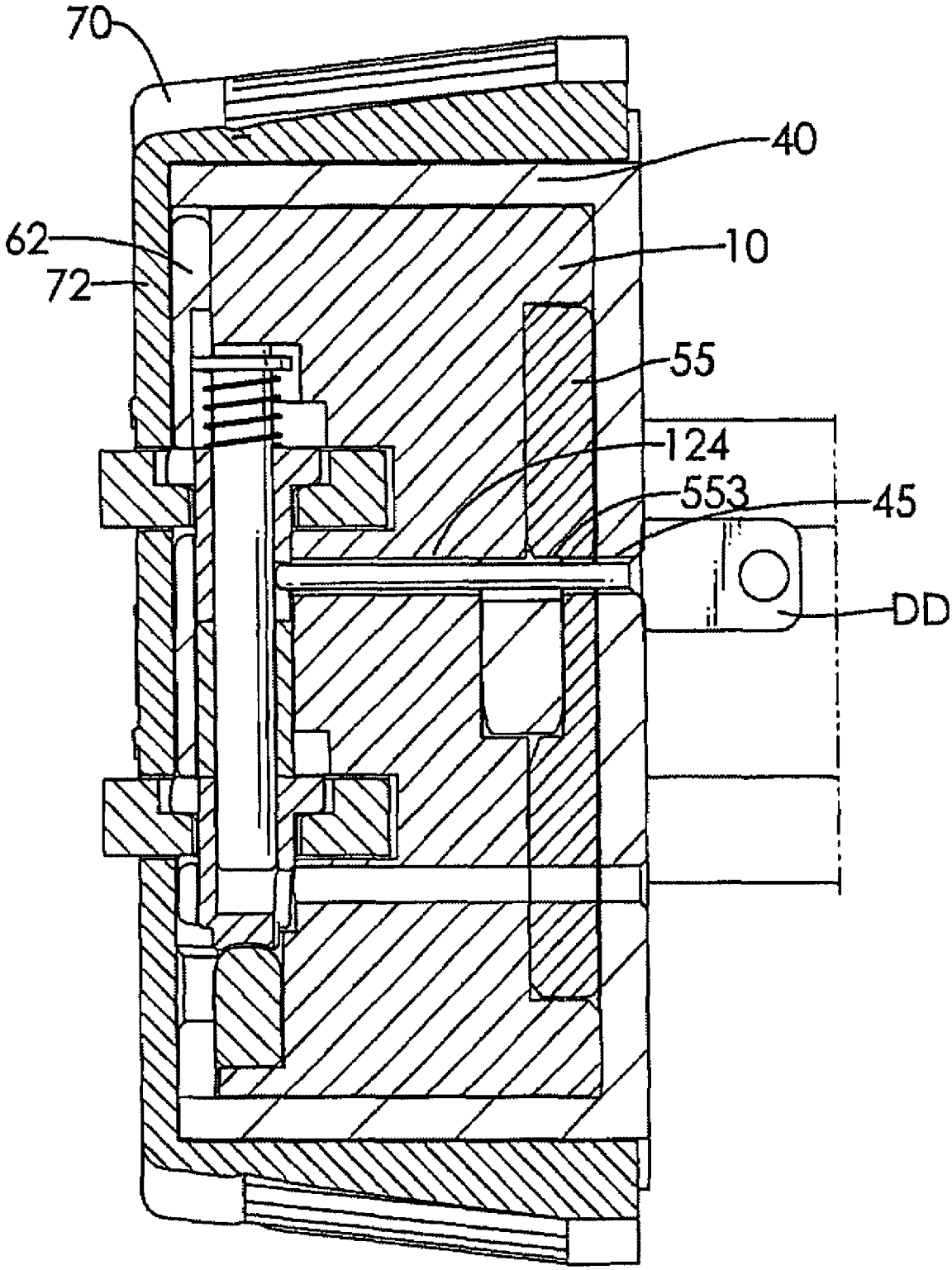
FIG. 6 is a side view in partial section of the lock in FIG. 1.
Figure 7:
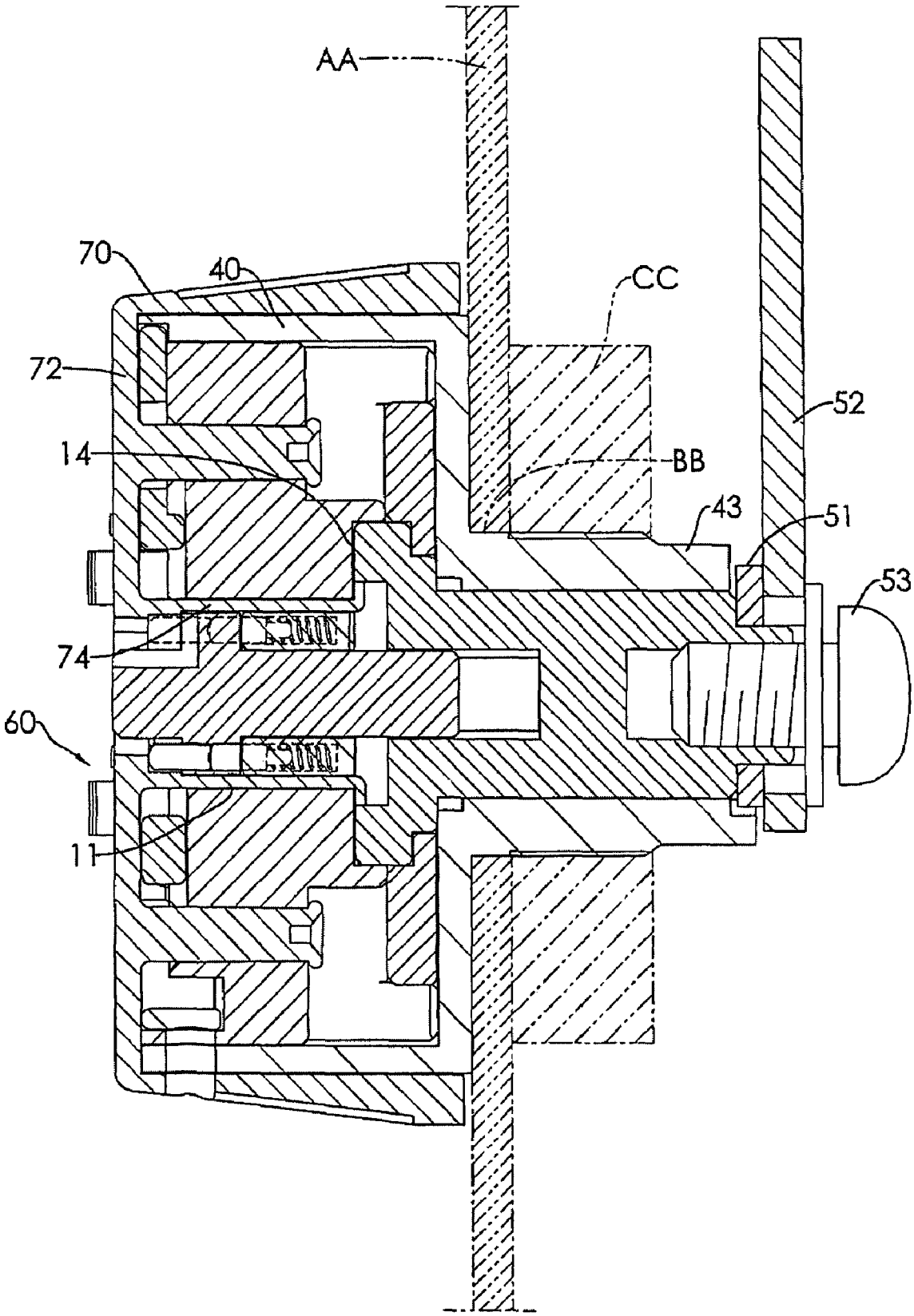
FIG. 7 is an operational side view in partial section of the lock in FIG. 1 with the compound lock mounted in a mounting hole of an article.
Figure 8:
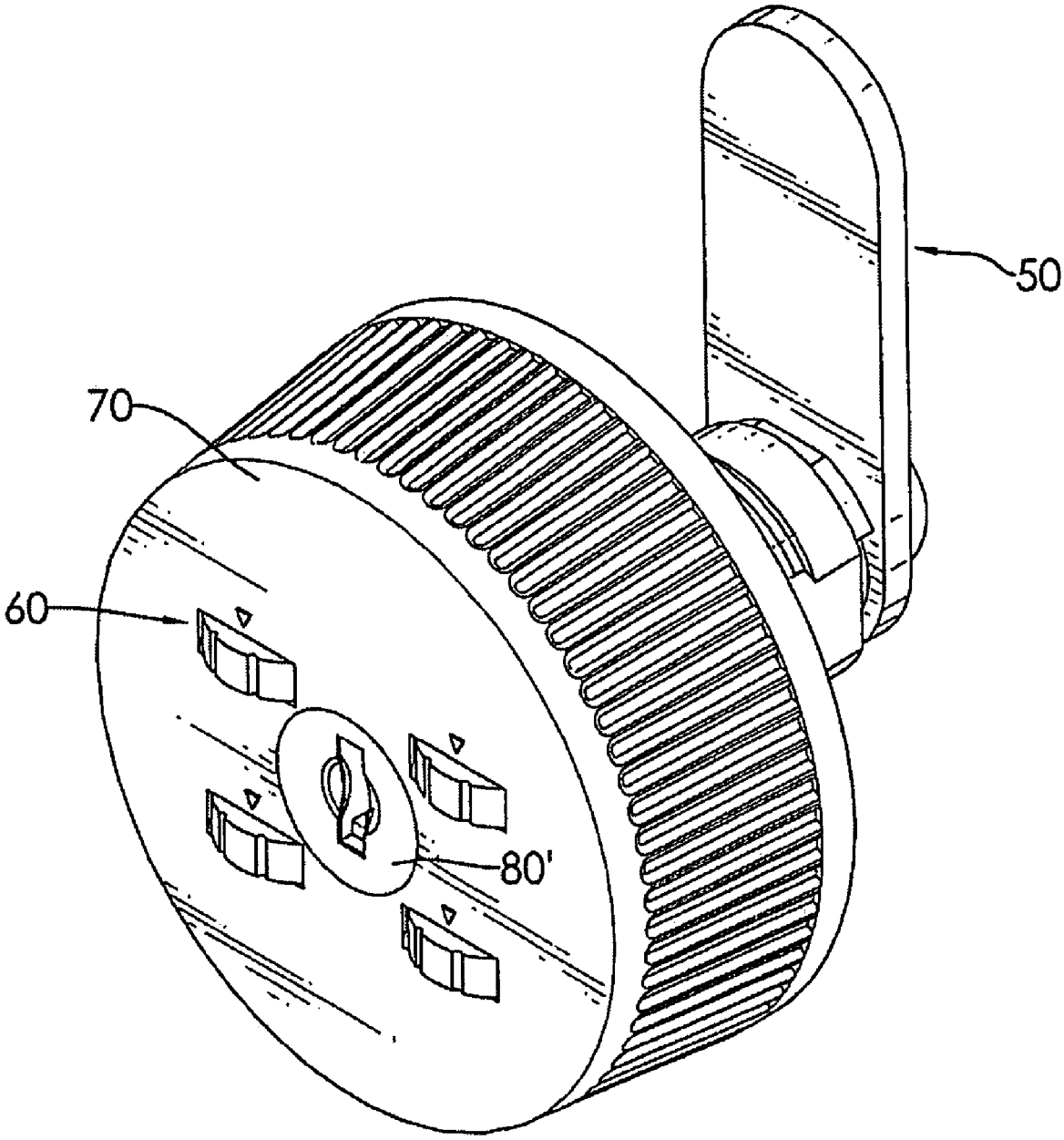
FIG. 8 is a perspective view of a second embodiment of a compound lock in accordance with present invention.
Figure 9:
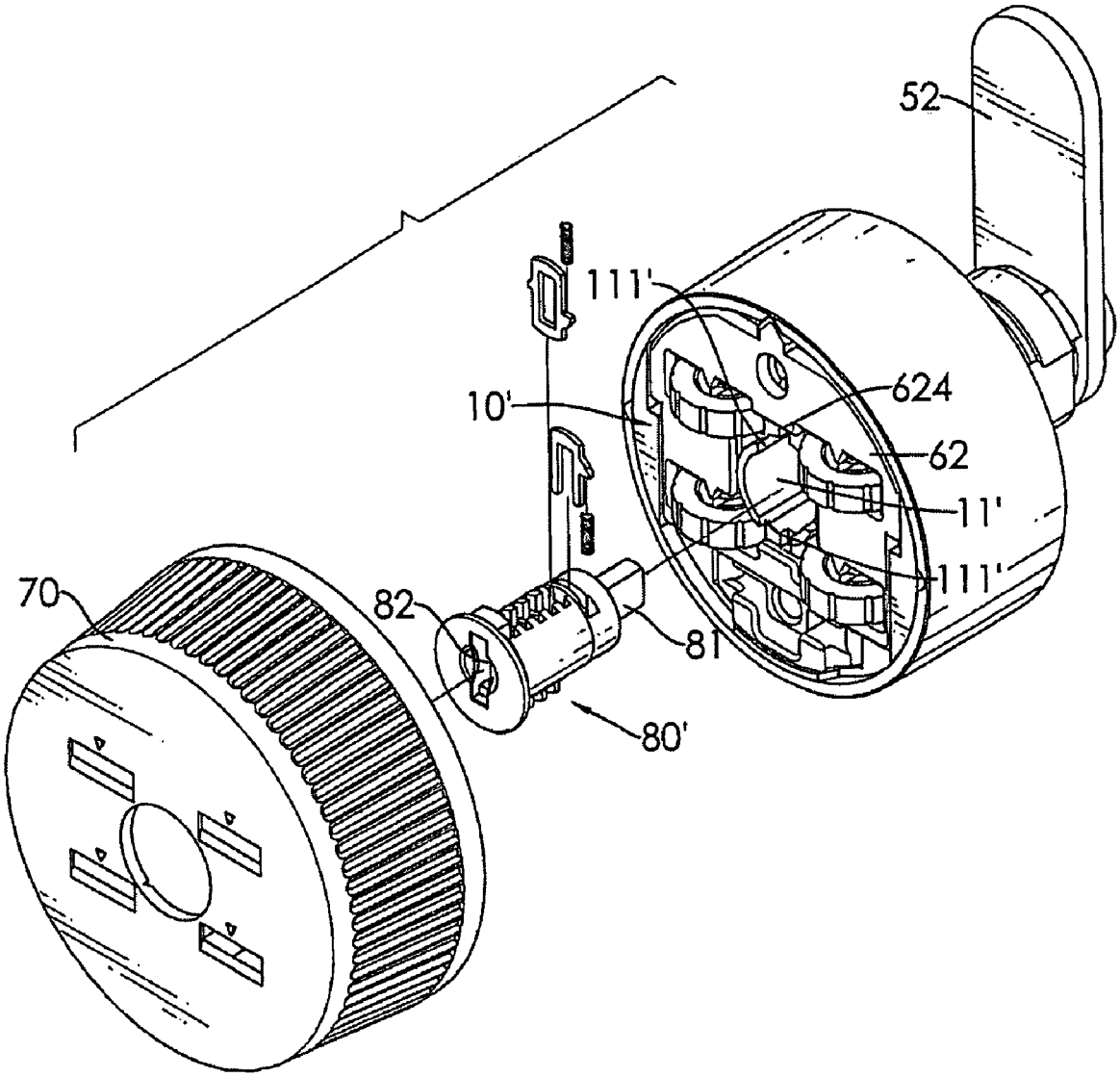
FIG. 9 is a partially exploded perspective view of the lock in FIG. 8.

With further reference to FIGS. 5 and 6, the latch panel (62) is mounted on the front surface of the inner housing (10, 10'), selectively connects to the outer housing (40) to lock the combination lock (60), selectively disconnects from the outer housing (40) to unlock the combination lock (60) and has a top, an inner surface, a locking protrusion (621), at least one wheel hole (622), at least one disconnect protrusion (623) and a central hole (624) and may have an elongated mounting hole (625).

The locking protrusion (621) is formed on and protrudes from the top of the latch panel (62) and corresponds to and is mounted selectively in the notch (46) in the inner surface of the outer housing (40) when the combination lock (60) is locked.

The at least one wheel hole (622) is formed through the latch panel (62), corresponds respectively to the transverse recess (122) of the inner housing (10, 10') and is mounted respectively around the at least one combination assembly (61). Each wheel hole (622) has a top edge.

The disconnect protrusions (623) are formed respectively on and protrudes down from the top edge of the at least one wheel hole (622) and corresponds respectively to and drop into the combination notches (611) of the at least one combination assembly (61) when all the unique combination numbers are aligned to disconnect the locking protrusion (621) from the notch (46) in the outer housing (40).

The central hole (624) is formed through the latch panel (62), corresponds to the supplementary lock hole (11, 11') of the inner housing (10, 10') and connects to the wheel holes (622) of the latch panel (62).

The elongated mounting hole (625) is formed through the latch panel (62), aligns with the positioning hole (13) of the inner housing (10, 10') and is mounted slidably by the rotation post (75) of the cap (70).

The combination yoke (63) is mounted in the combination yoke recess (17) of the inner housing (10, 10'), is used to set unique combination numbers respectively on the combination assemblies (61) and can be moved upward when the unique combination numbers are dialed in.

The compound lock as described has the following advantages. When the front panel (AA) of the article is closed, people may turn the cap (70) to rotate the inner housing (10, 10'), relative to the outer housing (40) until the locking protrusion (621) of the latch panel (62) corresponds the at least one notch (46) of the outer housing (40) and to lock the latch (52). Thus, the locking protrusion (621) of the latch panel (62) engages the at least one notch (46) of the outer housing (40) and the at least one combination notch (611) of the combination assembly (61) does not correspond to the disconnect protrusion (623) of the latch panel (62). The latch panel (62) is immovable. Therefore, the protrusion (621) of the latch panel (62) keeps engaging the at least one notch (46) of the outer housing (40), and the inner housing (10, 10') is securely mounted in the outer housing (40). The compound lock is locked. However, the supplementary lock (80, 80') can be operated with a key even when the combination lock (60) is locked to rotate the latch (52) and unlock the compound lock.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended, claims are expressed.

What is claimed is:

1. A compound lock comprising a common housing comprising an outer housing having a front;

a rear;

an inner surface;

a front edge being formed on the front of the outer housing;

a cover being formed on the rear of the outer housing;

an extension tube being formed coaxially on and protruding longitudinally from the cover and having an outer surface;

an end surface; and a thread being formed on the outer surface;

a central hole being formed through the extension tube and the cover;

and at least one notch being formed in the inner surface of the outer housing at the front edge;

an inner housing being cylindrical, being mounted coaxially in the outer housing and having a front surface;

a rear surface;

a supplementary lock hole being formed coaxially through the inner housing; and at least one combination assembly recess being formed on the front surface of the inner housing; and a cap being mounted around the outer housing, being fastened to the inner housing and having an open rear end;

a closed front end having an inner surface;

at least one wheel hole; and a supplementary lock hole corresponding to the supplementary lock hole of the inner housing; and a sidewall;

a latch assembly being connected to the common housing and having a core bracket being cylindrical, being connected to the rear surface of the inner housing and having a front end;

a rear end; and a slot being formed axially on the front end of the core bracket, communicating with the supplementary lock hole of the inner housing and engaging the drive shaft of the supplementary lock;

a mounting collar being mounted rotatably around the core bracket, fastening to the rear surface of the inner housing and having a mounting hole being formed through the mounting collar and being mounted around the core bracket; and a latch being connected to the rear end of the core bracket and having a proximal end being connected to the rear end of the core bracket;

a supplementary lock being mounted in the supplementary lock hole of the inner housing, connecting to the core bracket and having a rear surface;

a front surface; and a drive shaft being formed on and protruding coaxially from the rear surface of the supplementary lock; and a combination lock being mounted in the inner housing, selectively connecting to the outer housing or disconnecting from the outer housing and having at least one combination assembly being rotatably mounted respectively in the at least one combination assembly recess of the front surface of the inner housing, protruding respectively through the wheel holes in the closed front end of the cap and having at least one unique combination number; and at least one combination notch corresponding to the unique combination number.

2. The compound lock as claimed in claim 1, wherein the supplementary lock further has a key mount being formed coaxially on the front surface of the supplementary lock and being exposed through the supplementary lock hole in the closed front end of the cap.

3. The compound lock as claimed in claim 2, wherein the supplementary lock hole of the inner housing is a mounting hole;

the cap further has a fastening bracket being formed coaxially on and protruding longitudinally from the inner surface of the closed front end, being mounted through the mounting hole of the inner housing and having a distal end being attached securely to the recess of the inner housing;

the supplementary lock is a pin lock assembly being mounted securely in the mounting hole of the inner housing; and the key mount is mounted in the fastening bracket of the cap.

4. The compound lock as claimed in claim 2, wherein the supplementary lock hole of the inner housing is a mounting tube having a wall protruding from the front surface of the inner housing around the mounting tube; and two notches being formed on the wall opposite to each other; and the supplementary lock is a disc lock assembly being mounted securely in the mounting tube of the inner housing.

5. The compound lock as claimed in claim 3, wherein each one of the at least one combination assembly recess has two wheel chambers being formed opposite to each other on the front surface of the inner housing and connecting to each other, and each wheel chamber having a transverse recess being parallel to the other transverse recess of the wheel chamber; and a longitudinal recess connects to the other longitudinal recess of the wheel chamber, being perpendicular to the transverse recess; and a panel recess being formed on the front surface of the inner housing beside the transverse recesses;

the wheel holes of the closed front end of the cap correspond respectively to the transverse recesses of the inner housing; and the combination lock further has a latch panel being mounted on the front surface of the inner housing, selectively connecting to the outer housing to lock the combination lock, selectively disconnecting from the outer housing to unlock the combination lock and having a top;

an inner surface;

a locking protrusion being formed on and protruding from the top of the latch panel and corresponding to and being mounted selectively in the notch in the inner surface of the outer housing;

at least one wheel hole being formed through the latch panel and corresponding respectively to the transverse recess of the inner housing, being mounted respectively around the at least one combination assembly and each wheel hole having a top edge;

at least one disconnect protrusion being formed respectively on and protruding down from the top edge of the at least one wheel hole and corresponding respectively to and dropping into the combination notches of the at least one combination assembly; and a central hole being formed through the latch panel, corresponding to the supplementary lock hole of the inner housing and connecting to the wheel holes of the latch panel; and the wheel holes of the closed front end of the cap correspond respectively to the wheel holes of the latch panel of the combination lock.

6. The compound lock as claimed in claim 4, wherein each one of the at least one combination assembly recess having two wheel chambers being formed opposite to each other on the front surface of the inner housing and connecting to each other, and each wheel chamber having a transverse recess being parallel to the other transverse recess of the wheel chamber; and a longitudinal recess connects to the other longitudinal recess of the wheel chamber, being perpendicular to the transverse recess; and a panel recess being formed on the front surface of the inner housing beside the transverse recesses;

the wheel holes of the closed front end of the cap correspond respectively to the transverse recesses of the inner housing; and the combination lock further has a latch panel being mounted on the front surface of the inner housing, selectively connecting to the outer housing to lock the combination lock, selectively disconnecting from the outer housing to unlock the combination lock and having a top;

an inner surface;

a locking protrusion being formed on and protruding from the top of the latch panel and corresponding to and being mounted selectively in the notch in the inner surface of the outer housing;

at least one wheel hole being formed through the latch panel and corresponding respectively to the transverse recess of the inner housing, being mounted respectively around the at least one combination assembly and each wheel hole having a top edge;

at least one disconnect protrusion being formed respectively on and protruding down from the top edge of the at least one wheel hole and corresponding respectively to and dropping into the combination notches of the at least one combination assembly; and a central hole being formed through the latch panel, corresponding to the supplementary lock hole of the inner housing and connecting to the wheel holes of the latch panel; and the wheel holes of the closed front end of the cap correspond respectively to the wheel holes of the latch panel of the combination lock.

7. The compound lock as claimed in claim 5, wherein the outer housing further has multiple identification holes being formed through the cover around the extension tube of the outer housing;

the longitudinal recess of the inner housing further has an identification hole being formed through the inner housing and aligning with the identification hole in the outer housing; and the mounting collar further has multiple identification holes being formed through the mounting collar and aligning with the identification holes of the outer housing and the inner housing.

8. The compound lock as claimed in claim 6, wherein the outer housing further has multiple identification holes being separately formed through the cover around the extension tube of the outer housing;

the longitudinal recess of the inner housing further has an identification hole being formed through the inner housing and aligning with the identification hole in the outer housing; and the mounting collar further has multiple identification holes being formed through the mounting collar and aligning with the identification holes of the outer housing and the inner housing.

9. The compound lock as claimed in claim 7, wherein the outer housing further has a sidewall; and a through hole being formed through the sidewall of the outer housing near the front edge;

the inner housing further has an edge protruding from the front surface of the inner housing;

a through hole being formed through the edge of the inner housing near the at least one combination assembly recess and corresponding to and aligning with the through hole of the outer housing; and a combination yoke recess being formed in the front surface near the edge of the inner housing and connecting to the at least one combination assembly recess;

the cap further has a through hole being formed through the sidewall of the cap and corresponding to and aligning with the through holes of the outer housing and the inner housing; and the combination lock further has a combination yoke being mounted in the combination yoke recess of the inner housing and being used to set unique combination numbers respectively on the combination assemblies.

10. The compound lock as claimed in claim 8, wherein the outer housing further has a sidewall; and a through hole being formed through the sidewall of the outer housing near the front edge;

the inner housing further has an edge protruding from the front surface of the inner housing;

a through hole being formed through the edge of the inner housing near the at least one combination assembly recess and corresponding to and aligning with the through hole of the outer housing; and a combination yoke recess being formed in the front surface near the edge of the inner housing and connecting to the at least one combination assembly recess;

the cap further has a through hole being formed through the sidewall of the cap and corresponding to and aligning with the through holes of the outer housing and the inner housing; and the combination lock further has a combination yoke being mounted in the combination yoke recess of the inner housing and being used to set unique combination numbers respectively on the combination assemblies.

11. The compound lock as claimed in claim 9, wherein the inner housing further has multiple positioning holes being formed on the front surface of the inner housing; and multiple fastening holes being formed in the rear surface of the inner housing around the supplementary lock hole;

the cap further has multiple rotation posts being formed on and protruding longitudinally from the inner surface of the closed front end, being mounted securely in the positioning holes of the inner housing and rotating the inner housing;

the latch panel further has an elongated mounting hole being formed through the latch panel, aligning with the positioning hole of the inner housing and being mounted slidably by the rotation post of the cap;

the mounting collar further has multiple through holes being formed through the mounting collar; and the latch assembly further has multiple collar fasteners being mounted respectively through the through holes and fastening to the fastening holes of the inner housing.

12. The compound lock as claimed in claim 10, wherein the inner housing further has multiple positioning holes being formed on the front surface of the inner housing; and multiple fastening holes being formed in the rear surface of the inner housing around the supplementary lock hole;

the cap further has multiple rotation posts being formed on and protruding longitudinally from the inner surface of the closed front end, being mounted securely in the positioning holes of the inner housing and rotating the inner housing;

the latch panel further has an elongated mounting hole being formed through the latch panel, aligning with the positioning hole of the inner housing and being mounted slidably by the rotation post of the cap;

the mounting collar further has multiple through holes being formed through the mounting collar; and the latch assembly further has multiple collar fasteners being mounted respectively through the through holes and fastening to the fastening holes of the inner housing.

13. The compound lock as claimed in claim 11, wherein the central hole of the outer housing is a threaded hole; and the mounting hole of the core bracket is a threaded hole.

14. The compound lock as claimed in claim 12, wherein the central hole of the outer housing is a threaded hole; and the mounting hole of the core bracket is a threaded hole.

15. The compound lock as claimed in claim 1, wherein the inner housing further has a recess being formed in the rear surface of the inner housing coaxially with the supplementary lock hole; and the core bracket further has a flange being formed around and protruding out from the front end of the core bracket and being mounted in the recess of the inner housing.

16. The compound lock as claimed in claim 1, wherein the core bracket further has a keyed protrusion protruding axially from the rear end of the core bracket; and a mounting hole being formed axially in the rear end of the core bracket through the keyed protrusion; and the latch is securely mounted around the keyed protrusion of the core bracket and has keyed hole being formed through the latch near the proximal end and corresponding to and being mounted securely around the keyed protrusion of the core bracket.

17. The compound lock as claimed in claim 16, wherein the extension tube of the outer housing further has a positive stop being an arc and being formed concentrically on and protrudes longitudinally from the end surface; and the latch assembly further has a limit being mounted around the keyed protrusion, abutting the rear end of the core bracket, slidably abutting the end surface of the extension tube and having an edge;

a keyed hole corresponding to the keyed protrusion of the core bracket; and a protrusion being formed on and protruding out from the edge of the limit and selectively abutting the positive stop of the outer housing.

18. The compound lock as claimed in claim 17, wherein the latch assembly further has a latch fastener being mounted through the keyed holes of the latch and the limit and screwing into the mounting hole of the keyed protrusion of the core bracket.

19. The compound lock as claimed in claim 1, wherein the sidewall of the cap is fluted.

* * * * *